US005467674A

United States Patent [19]

Thorn

[11] Patent Number: 5,467,674

[45] Date of Patent: Nov. 21, 1995

[54] COMBINED TORQUE LIMITING AND MARKING WRENCH

[76] Inventor: Brent Thorn, 280 S. Center, Northville, Mich. 48167

[21] Appl. No.: 287,968

[22] Filed: Aug. 9, 1994

[51] Int. Cl.[6] ..... B25B 23/145

[52] U.S. Cl. ..... 81/468; 81/467

[58] Field of Search ..... 81/468, 467, 472–478, 81/480–483

[56] References Cited

U.S. PATENT DOCUMENTS

| | | | |
|---|---|---|---|
| 3,523,471 | 8/1970 | Lance | 81/468 |
| 3,667,327 | 6/1972 | Lance | 81/468 |
| 4,393,734 | 7/1983 | Thorn et al. | 81/468 |

*Primary Examiner*—Bruce M. Kisliuk
*Assistant Examiner*—Joni B. Danganan
*Attorney, Agent, or Firm*—Dinnin & Dunn

[57] ABSTRACT

An improved combined torque limiting and part marking wrench according to the present invention includes: a torque-applying handle; a housing pivotally mounted to the handle, the housing adapted to receive a releasably mounted, replaceable, part-engaging head assembly at a second end thereof; and a part-marking mechanism mounted within the housing. The part-marking mechanism includes a marking tip which passes through a bore in the head assembly for marking a part. A mechanical linkage arm is pivotally connected to the torque-applying handle. A pivotable cam is pivotally connected to the linkage arm and in operative engagement with the part-marking mechanism for moving the marking tip through the bore, such that, when torque on a part has reached a predetermined value, the torque applying handle moves the linkage arm, which pivots the pivotable cam, thus forcing the pivotable cam against the part marking mechanism, which causes the marking tip to extend outwardly from the housing to mark the part. An alternative torque limiting and part-marking wrench according to the present invention includes a marking tube connected at an angle to the housing and a pair of cammingly engaged plungers which actuate the part-marking mechanism.

2 Claims, 2 Drawing Sheets

COMBINED TORQUE LIMITING AND MARKING WRENCH

TECHNICAL FIELD

The present invention relates to a torque limiting wrench, and more particularly to a torque limiting wrench having a marking mechanism which marks a part when the part has been manipulated to a desired level of torque.

BACKGROUND OF THE INVENTION

Torque limiting wrenches have applications in various manufacturing environments where application of a consistent level of torque is needed. There are numerous reasons for desiring consistency in application of torque in a manufacturing process, such as, avoiding localized stressing of parts and assuring full tightening of fasteners.

It would be desirable for a manufacturing quality inspector to be able to visually check the level of torque applied to fasteners in a manufacturing environment. My previous patent, U.S. Pat. No. 4,393,734, herein incorporated by reference, discloses an invention which provides this inspection capability. This invention uses a pneumatic line to create pressure in a torque limiting wrench housing when the desired level of torque is reached. This pressure causes an ink-marking unit to slide toward the part and mark it for an inspector to see.

However, there are several problems with my previous invention. The attachment of a pneumatic line greatly limits the functional use of this tool in a manufacturing environment. It can be very difficult, cumbersome and prohibitively costly to provide pneumatic lines to certain locations in a manufacturing facility or assembly line. In addition, the attachment of these pneumatic lines limits the travel of the unit, i.e., the user is unable to walk around and perform work in areas where workspace is limited, areas where pneumatic lines are unavailable, or outside.

Another problem with my previous invention is that the use of metal-tipped ink-marking striking pins is inefficient. Not only is the ink mark difficult to see, but relatively large pneumatic line pressures are required in order to sufficiently force the striking pin against the part to mark the part.

Therefore, it would be desirable to develop a combined torque limiting and marking wrench which does not have the previously mentioned limitations.

SUMMARY OF THE INVENTION

An improved combined torque limiting and part marking wrench according to the present invention includes: a torque-applying handle; a housing pivotally mounted to the handle, the housing adapted to receive a releasably mounted, replaceable, part-engaging head assembly at a second end thereof; and a part-marking mechanism mounted within the housing. The part-marking mechanism includes a felt marking tip which passes through a bore in the head assembly for marking a part. A mechanical linkage arm is pivotally connected to the torque-applying handle. A pivotable cam is pivotally connected to the linkage arm and in operative engagement with the part-marking mechanism for moving the marking tip through the bore, such that, when torque on a part has reached a predetermined value, the torque applying handle moves the linkage arm, which pivots the pivotable cam, thus forcing the second end of the pivotable cam against the part marking mechanism, which causes the marking tip to extend outwardly from the housing to mark the part.

An alternative torque limiting and part-marking wrench according to the present invention includes a torque-applying handle and a housing pivotally mounted to the torque-applying handle. A first plunger is slidably movable within a bore in the housing. A mechanical linkage arm pivotally connects the torque-applying handle to a pivotable cam. The pivotable cam is in operative engagement with the first plunger for sliding the first plunger along the bore. A marking tube is connected to the housing and is adapted to receive a releasably mounted, replaceable, part-engaging head assembly. The axis of the tube is at an angle relative to the axis of the first plunger. A second plunger is slidably movable within the marking tube and has a cammed end in camming engagement with a cammed end of the first plunger. A part marking mechanism is located within the marking tube, and includes a marking tip which passes through a bore in the head assembly. The part marking assembly is slidably movable within the marking tube, such that, when torque on a part has reached a predetermined value, the torque-applying handle moves the linkage arm, which pivots the pivotable cam, and forces the pivotable cam against the first plunger, sliding the first plunger along the bore, which causes the cammed surfaces of the first and second plungers to engage, and the second plunger slides along the marking tube, which moves the part marking mechanism toward the part to be marked, and the marking tip extends outwardly from the tube to mark the part.

Accordingly, an object of the present invention is to provide a combination torque limiting and marking wrench which is universally movable, in that it requires no pneumatic or electric attachments.

A further object of the present invention is to provide a combined torque limiting and marking wrench which does not have the previously mentioned limitations and is relatively simple and inexpensive to manufacture.

A still further object of the present invention is to provide a combined torque limiting and marking wrench without a metal striking pin, thereby eliminating the need for pneumatic pressure to force the striking pin against a part to be marked.

Another object of the present invention is to provide a combined torque limiting and marking wrench in which the part-engaging head assembly is at an angle relative to the handle to allow for part manipulation in limited working spaces.

Yet another object of the present invention is to provide a combined torque limiting and marking wrench in which the ink cartridge and marking tip are easily replaceable.

These and other objects, features and advantages of the present invention will be more thoroughly understood with reference to the accompanying drawings and description.

BEST MODES FOR CARRYING OUT THE INVENTION

Figure 1:
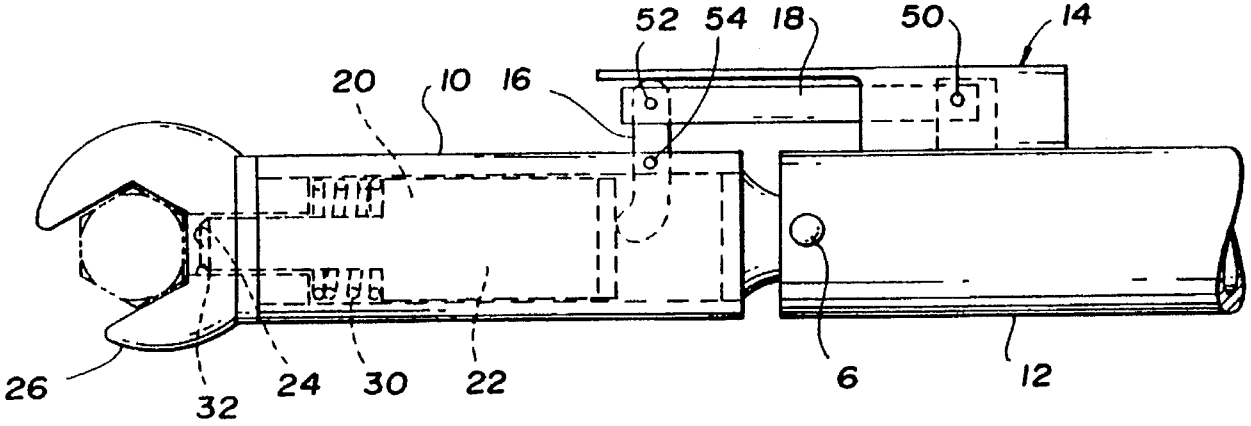
FIG. 1 shows a plan view of a torque limiting and marking wrench according to the present invention.
Figure 2:
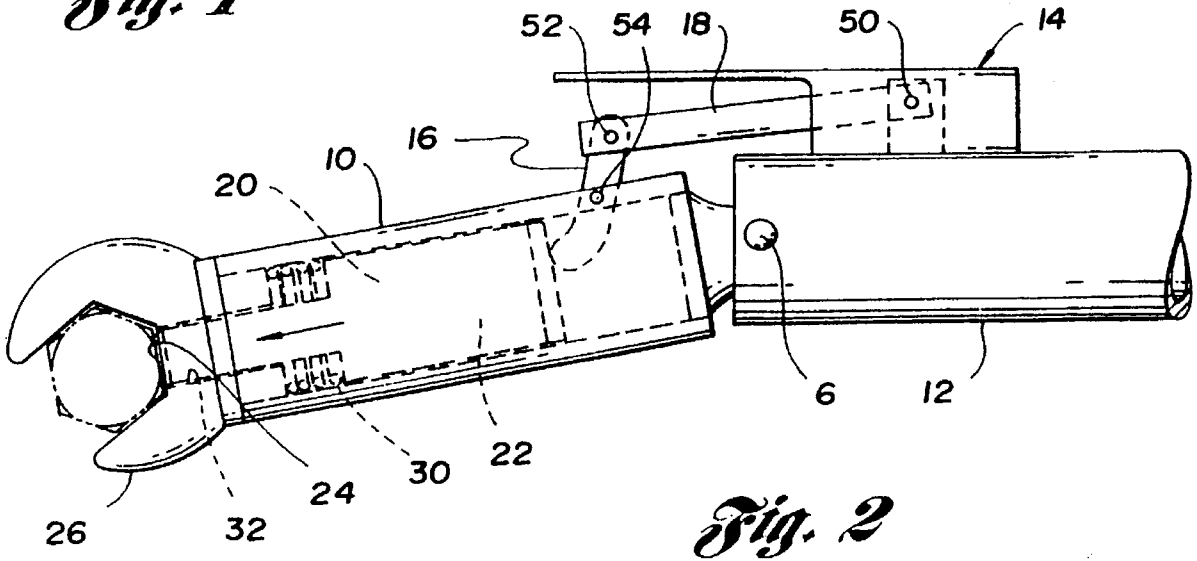
FIG. 2 shows a plan view of a torque limiting and marking wrench according to the present invention as a part is being marked.

Referring to FIGS. 1 and 2, a torque limiting and marking wrench according to the present invention is shown. This wrench is used to tighten fasteners. The torque-applying handle 12 is pivotally connected to the first end of the housing 10 at the pivot joint 6. When the wrench achieves a desired level of torque, the torque-applying handle 12 releases and pivots about the pivot joint 6, as shown in FIG. 2. The torque limiting aspect of the wrench is known in the art and similar to that of U.S. Pat. No. 3,523,471 to Lance. This pivoting action creates relative pivotal movement between the handle 12 and the housing 10. The relative movement between the handle 12 and the housing 10 is used to actuate movement the part-marking mechanism 20, thus marking the part when it has been tightened to a desired torque level.

A linkage arm 18 is pivotally connected to the torque-applying handle 12 at the first pivot 50. A second pivot 52 pivotally connects the linkage arm 18 to a first end of the pivotable cam 16. A third pivot 54 pivotally connects the pivotable cam 16 to the housing 10. The second end of the pivotable cam 16 is in operative engagement with the part-marking mechanism 20. The part-marking mechanism 20 is mounted within the housing 10 and is slidably movable therein.

The second end of the pivotable cam 16 pushes against the part-marking mechanism 20, thus sliding the part-marking mechanism 20 toward the part to be marked. The marking tip 24 extends through the bore 32 in the head assembly 26 to mark the part. A felt tip is used for the marking tip 24, which requires much less force to mark a part than did the previous metal striking pin, thus alleviating the need for pneumatic pressure lines. The felt marking tip also provides a more highly visible mark than a metal striking pin. After the part is marked by the marking tip 24, the return spring 30 returns the part-marking mechanism 20 toward the rear of the housing 10.

The head assembly 26 is releasably mounted within the second end of the housing 10 for engaging parts. The head assembly 26 is fully replaceable for different applications requiring a different head size. Furthermore, replacement of the ink cartridge 22 in the part-marking mechanism 20 may be accomplished by removing the head assembly 26 and sliding the part-marking mechanism 20 and return spring 30 out of the second end of the housing.

A mechanism cover 14 is mounted to the handle 12 and protects the linkage arm 18 and pivotable cam 16.

The range of pivotal motion of the handle 12 relative to the housing 10 is adjusted to accommodate the stroke required for the marking tip 24. For example, at least 15 degrees of rotational movement about the pivot joint 6 may be necessary to provide sufficient stroke to the marking tip 24 when using a standard felt-tip cartridge.

Figure 3:
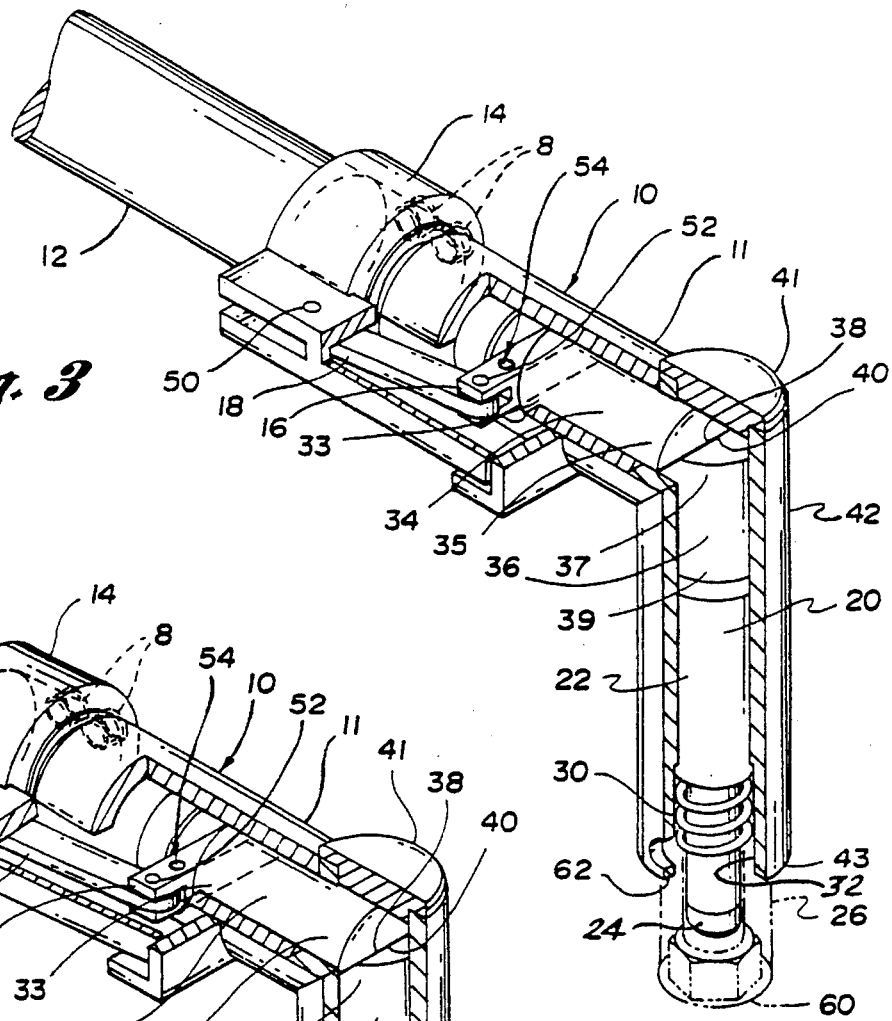
FIG. 3 shows a partially cut-away perspective view of an alternative torque limiting and marking wrench according to the present invention.
Figure 4:
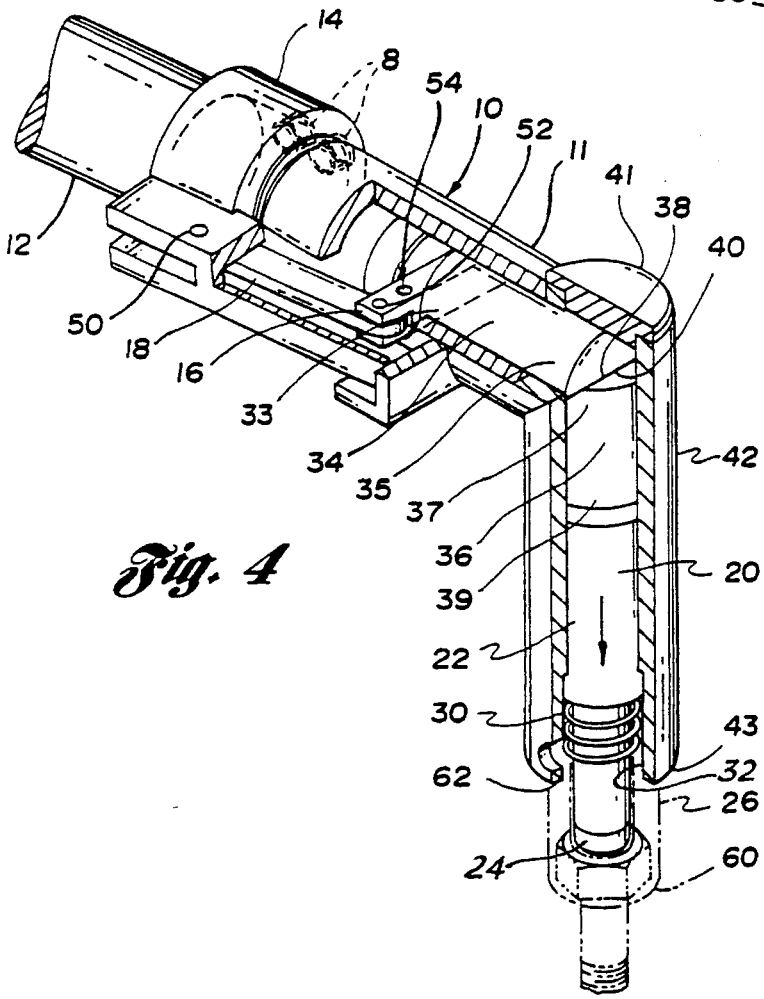
FIG. 4 shows a partially cut-away perspective view of an alternative torque limiting and marking wrench according to the present invention as a part is being marked.

Turning now to FIGS. 3 and 4, an alternative torque limiting and marking wrench according to the present invention is shown. This embodiment is generally used to employ a socket-type wrench.

The torque-applying handle 12 is pivotally connected to the first end of the housing 10 at the pivot joint, similar to pivot joint 6 as shown in FIGS. 1 and 2. When the wrench achieves a desired level of torque, the torque-applying handle 12 releases and pivots about the pivot joint, as shown in FIGS. 1 and 2 This pivoting action creates relative pivotal movement between the handle 12 and the housing 10. The relative movement between the handle 12 and the housing 10 is used to actuate movement of the part-marking mechanism 20, thus marking the part when it has been tightened to a desired torque level.

A linkage arm 18 is pivotally connected to the torque-applying handle 12 at the first pivot 50. A mechanism cover 14 is connected to the handle 12 and protects the linkage arm 18. A second pivot 52 pivotally connects the linkage arm 18 to a first end of the pivotable cam 16. A third pivot 54 pivotally connects the pivotable cam 16 to the housing 10.

A first plunger 34 is slidably movable within the housing 10. The second end of the pivotable cam 16 is in operative engagement with a first end 33 of the first plunger 34 for sliding the first plunger 34 along the housing 10. The second end 35 of the first plunger 34 has a cammed surface 38.

A first end 41 of the marking tube 42 is connected to the second end 11 of the housing 10. The second end 43 of the marking tube 42 is adapted to receive a releasably mounted, replaceable, part-engaging head assembly 26, the axis of the tube 42 being at an angle to the axis of the first plunger 34. The head assembly 26 includes a socket portion 60 having an open part-engaging area and a shank portion 62 which is releasably retained within the second end 43 of the marking tube 42.

A second plunger 36 is slidably movable within the marking tube 42. A first end 37 of the second plunger 36 has a cammed surface 40, which is in camming engagement with the cammed surface 38 at the second end 35 of the first plunger 34.

A part-marking mechanism 20 located within the marking tube 42 includes a marking tip 24 which passes through a bore 32 in the head assembly shank portion 62 for reciprocal movement. The part-marking mechanism 20 is slidably movable within the marking tube 42, and the marking tip 24 is extendible outwardly from the tube 42 for marking a part. The part-marking mechanism 20 is movable by the second plunger 36, such that, when torque on a part has reached a predetermined value, the torque applying handle 12 pivots relative to the housing 10, moving the linkage arm 18, which pivots the pivotable cam 16, and forces the second end of the pivotable cam 16 against the first end 33 of the first plunger 34, sliding the first plunger 34 along the tube 42, which causes the cammed surfaces 38,40 of the first and second plungers 34,36 to engage, and the second plunger 36 slides along the marking tube 42, which moves the part marking mechanism 20 toward the part to be marked. The marking tip 24 extends outwardly from the tube 42 to mark the part.

When the part has been marked, the handle 12 will return to its original position, as shown in FIG. 1, and the part-marking mechanism 20 will return toward the first end 41 of the marking tube 42 with the aid of the return spring 30.

The part-marking mechanism 20 includes a replaceable ink cartridge 22 therein. The cartridge 22 is refillable and reusable, and may be filled with any desired color, including known dyes and inks which may be washed off the part after inspection.

The second end 43 of the marking tube 42 is designed to accommodate different socket sizes, thus allowing quick and simple socket size changes.

The relative angle between the axis of the marking tube 42 and the axis of the first plunger 34 may be varied to achieve a desired configuration for differing manufacturing environments.

While the best modes for carrying out the invention have been described in detail, those familiar with the art to which the invention relates will recognize various alternative designs and embodiments for practicing the invention as defined by the following claims.

What is claimed is:

1. An improved torque limiting and part marking wrench of the type having:

a torque-applying handle;

a housing pivotally mounted at a first end to the torque-applying handle, said housing adapted to receive a releasably mounted, replaceable, part-engaging head assembly at a second end thereof;

a part-marking mechanism mounted within said housing; and said part-marking mechanism including a marking tip that passes through a bore in said head assembly for reciprocal movement within said bore, and being extendible outwardly from said housing for marking a part in said part engaging head assembly;

the improvement comprising;

a mechanical linkage arm pivotally connected to the torque-applying handle; and a pivotable cam having first and second ends, said cam being pivotally connected at said first end to said linkage arm, and in operative engagement at said second end with said part-marking mechanism for moving said marking tip through said bore toward said part to be marked, and said cam being pivotally connected at a point between said first and second ends to said housing, such that, when torque on a part has reached a predetermined value the torque-applying handle releases and pivots about a pivot joint, the torque applying handle moves the linkage arm, which pivots the pivotable cam, thus forcing the second end of the pivotable cam against the part marking mechanism, which causes the marking tip to extend outwardly from said housing to mark the part.

2. A torque limiting and part marking wrench comprising:

a torque-applying handle;

a housing having first and second ends, and pivotally mounted at said first end to the torque-applying handle;

a first plunger having first and second ends, having a cammed surface at said second end, and being slidably movable within a bore in said housing;

a mechanical linkage arm pivotally connected to the torque-applying handle;

a pivotable cam having first and second ends, pivotally connected at said first end to said linkage arm, in operative engagement at said second end with said first end of said first plunger for sliding said first plunger along said bore in a first direction, and said cam being pivotally connected at a point between said first and second ends of said pivotable cam to said housing;

a marking tube having first and second ends, connected at said first end to said second end of said housing and adapted to receive a releasably mounted, replaceable, part-engaging head assembly at said second end of said tube, the axis of said tube being at an angle to the axis of said first plunger, said head assembly including a wrench head portion having an open part-engaging area and a shank portion which is releasably retained within said second end of said marking tube;

a second plunger slidably movable within said marking tube, a first end of said second plunger having a cammed surface in camming engagement with the cammed surface at said second end of said first plunger; and a part-marking mechanism located within the marking tube, including a marking tip which passes through a bore in said head assembly shank portion for reciprocal movement, said part-marking mechanism being slidably movable within a bore in said marking tube, said marking tip being extendible outwardly from said tube from marking a part, and said part marking mechanism being movable by said second plunger, such that, when torque on a part has reached a predetermined value the torque applying handle releases and pivots about a pivot joint, the torque applying handle moves the linkage arm, which pivots the pivotable cam, and forces the second end of the pivotable cam against the first end of the first plunger, sliding the first plunger in said first direction, which causes the cammed surfaces of the first and second plungers to engage, and the second plunger slides along the marking tube, which moves the part marking mechanism toward the part to be marked, and the marking tip extends outwardly from said tube to mark the part.

* * * * *